United States Patent [19]

Brawn

[11] 4,114,616

[45] Sep. 19, 1978

[54] POSITIVE REINFORCEMENT RESPIRATORY INHALATION DEVICE

[76] Inventor: Peter Nelson Brawn, 1711 26th Ave., Seattle, Wash. 98112

[21] Appl. No.: 833,960

[22] Filed: Sep. 16, 1977

Related U.S. Application Data

[63] Continuation of Ser. No. 684,424, Jun. 7, 1976, abandoned, which is a continuation-in-part of Ser. No. 542,795, Jan. 21, 1975, Pat. No. 3,972,326, which is a continuation-in-part of Ser. No. 435,877, Jan. 23, 1974, abandoned.

[51] Int. Cl.[2] ..... A61M 15/00

[52] U.S. Cl. ..... 128/210; 128/208; 128/211

[58] Field of Search ..... 128/210, 209, 196, 197, 128/188, 185, 201, 202, 204, 211, 140 R, 146 R, 141 R, 2.08, 2 F; 46/44 R; 272/99 R

[56] References Cited

U.S. PATENT DOCUMENTS

| | | | |
|---|---|---|---|
| 2,136,844 | 11/1938 | Fair et al. | 128/197 X |
| 2,342,602 | 2/1944 | Reitz, Jr. | 128/188 |
| 3,265,067 | 8/1966 | Ehlinger | 128/196 |
| 3,977,395 | 8/1976 | Brawn | 272/99 X |

FOREIGN PATENT DOCUMENTS

| | | | |
|---|---|---|---|
| 226,793 | 4/1943 | Switzerland | 128/210 |

*Primary Examiner*—Robert W. Michell
*Assistant Examiner*—Henry J. Recla
*Attorney, Agent, or Firm*—Finnegan, Henderson, Farabow & Garrett

[57] ABSTRACT

An improved positive reinforcement respiratory inhalation device of simple construction is provided for respiratory therapy while simultaneously providing to the user controlled ingestion of liquid. The device is used primarily for post-surgical patients when respiratory therapy is most important and restricted liquid intake is usually required. The respiratory inhalation device includes a container for holding liquid and a tube assembly having a first tube slideably coupled to and concentric with the second tube affixed to the container. In one version the tube assembly is affixed to the bottom wall portion of the container. One end of the tube assembly projects to a point adjacent the bottom wall of the container and the second end is adapted for insertion into the mouth of a user. One or the other or both of the first and second tubes are provided with openings in side wall portions thereof whose aperture is adjustable by the sliding movement of one tube relative to the other. The adjustment is made by a longitudinal movement of one tube relative to the second or in a modified embodiment the adjustment in aperture of the openings is made by a rotational movement of one tube about the longitudinal axis of the tube assembly.

14 Claims, 12 Drawing Figures

POSITIVE REINFORCEMENT RESPIRATORY INHALATION DEVICE

BACKGROUND OF THE INVENTION

This application is a continuation of Ser. No. 684,424 filed on June 7, 1976 and now abandoned and which is a continuation in part of application Ser. No. 542,795 filed on Jan. 21, 1975 now U.S. Pat. No. 3,972,326 which is a continuation in part of application Ser. No. 435,877 filed Jan. 23, 1974, which application is now abandoned.

This invention relates to a device used in respiratory therapy. Particularly, this device provides positive reinforcement to the patient to cause deep inhalation by rewarding him with a controlled intake of liquid.

Most hospitals in the United States have a 24 hour around the clock respiratory therapy department. Respiratory therapy is vitally important to the well being of every patient in a hospital and particularly to patients during the post operative period following surgery. The major emphasis of respiratory therapy is to encourage deep inhalation by the patient.

Following surgery patients experience great thirst because they are not allowed to take liquid orally. There is no oral intake of liquid for a period of two to three days following surgery because of gastro-intestinal motility secondary to the trauma of the surgery itself and the depressive effect of anesthesia. During this post operative period, the patients are particularly susceptible to the quite common problem of post operative atelectasis which is an incomplete expansion of the lung secondary to collapse of pulmonary alveoli.

The above referenced application Ser. No. 542,795 discloses a positive reinforcement respiratory inhalation device which consists of a container for holding liquid, a lid portion mounted on the container through which a first tube projects and is rigidly attached thereto. A second tube which has a plurality of openings at varying heights in the wall portion is slideably coupled to the first tube and can be moved relative to the first tube to selectively occlude the openings in its wall portion. With this device the amount of liquid withdrawn from the container for a given inspiratory effort by the user is controlled by the selective occlusion of the holes in the second tube.

The present invention represents an improvement over the just described device in that it provides greater versatility of use and its structure offers certain advantages which will be described below.

SUMMARY OF THE INVENTION

The present invention is of improved construction and utility over those devices previously available for respiratory therapy. The device of the present invention allows for limited liquid intake while providing respiratory therapy for atelectasis through deep breathing which is encouraged by use of this device. The amount of liquid to be taken by a patient can be adjustably controlled by a doctor or nurse or the user himself.

The improved positive reinforcement respiratory inhalation device of this invention is comprised of a container for holding liquid, a lid portion mounted on the container, a tube assembly which includes a first and second tube slideably coupled together and concentric one with the other projecting through and rigidly mounted to the lid, one end of the tube assembly projecting substantially to the bottom wall portion of the container and the other end of the tube assembly being adapted for insertion into the mouth of a user. The bottom portion of the tube assembly can be affixed directly to the bottom wall of the container or to the side wall adjacent the bottom wall of the container. If the tube assembly is so mounted, a lid portion for the container is not required. Openings are provided in the side wall portions of at least one of the two tubes and the apertures of the openings may be varied through either rotational or longitudinal movement of one tube relative to the other tube. Thus the amount of liquid withdrawn from the container for a given inspiratory effort by the patient can be controlled by the selective occlusion of the holes in the second tube, or if both tubes have openings in their respective walls the control can be maintained by selective registration of openings.

BRIEF DESCRIPTION OF THE DRAWINGS

In the drawings, FIG. 1B is a cross sectional view of the tube assembly.

FIG. 3B is a cross sectional view of the tube assembly of FIG. 3A.

DESCRIPTION OF THE PREFERRED EMBODIMENTS

Reference will now be made in detail to the present preferred embodiments of the invention, examples of which are illustrated in the accompanying drawings.

Figure 1A:
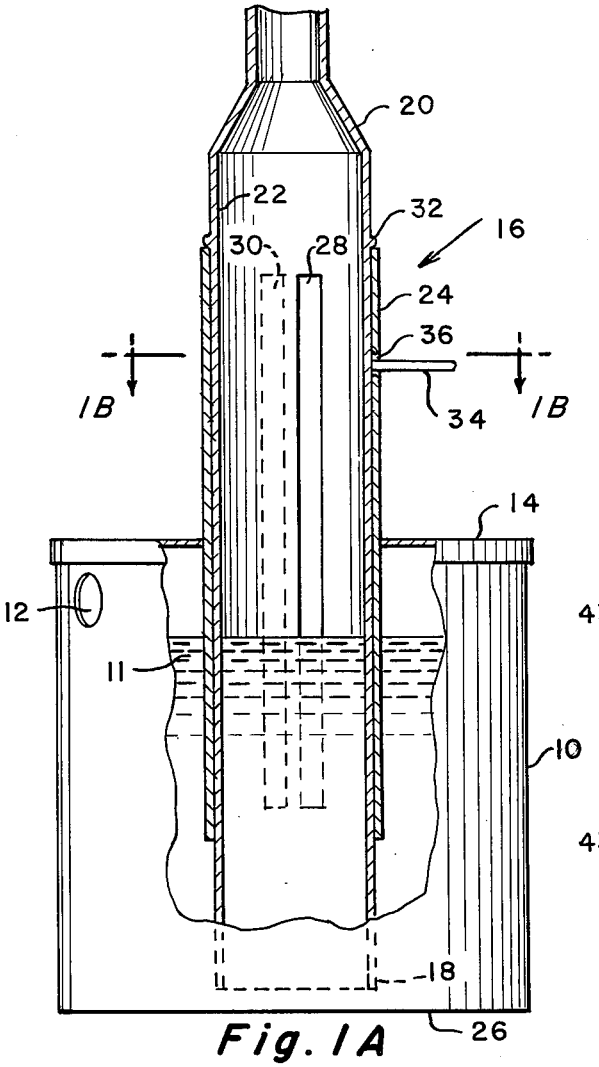
FIGS. 1A, 1B, 1C and 2 are preferred embodiments of the present invention shown schematically and in partial cross section wherein the opening apertures in the side walls of the tube assembly are adjusted by rotational movement of the tubes.
Figure 1B:
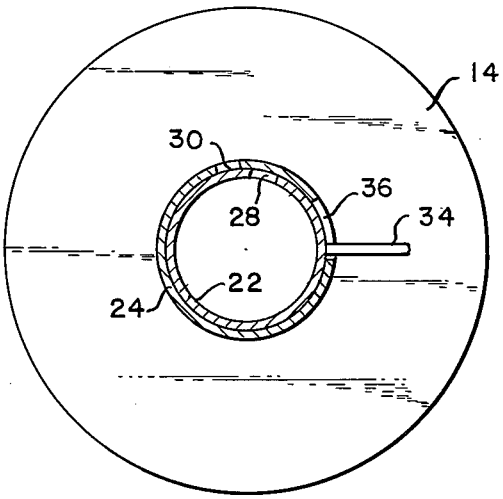

Referring first to FIGS. 1A and 1B, an improved positive reinforcement respiratory inhalation device which provides for controlled ingestion of liquid 11 into the mouth of the user is shown. According to this invention, a container 10 for holding liquid has at least one opening 12 in a wall portion thereof. Opening 12 communicates exterior atmospheric pressure to the interior of container 10 to the surface of liquid 11. Container 10 includes a wall portion which is lid 14.

According to this invention a tube assembly 16 has first and second ends 18 and 20. Preferably a first tube 22 is slidably coupled to and concentric with a second tube 24. As here embodied the first tube 22 fits within the second tube 24 such that its exterior periphery couples with the interior periphery of tube 24 allowing for rotational movement of the first tube 22 relative to the second tube 24.

The tube assembly 16 further is affixed to and projects through the lid portion 14. Preferably the first end 18 is adjacent the bottom wall 26 of container 10 thereby providing open communicating access between the first and second ends 18 and 20 of container 10. As shown here the second end 20 is exterior of container 10 and adapted to be inserted into the mouth of the user.

Preferably both first and second tubes 22 and 24 are provided respectively with openings 28 and 30 in wall portions thereof. Openings 28 and 30 are shown as rectangular-shaped aligned longitudinally of the tube assembly 16. As here embodied the openings 28 and 30 are registerable by a rotational movement of the first tube 22 relative to the stationary second tube 24 (see FIG. 1B).

Tube 22 is maintained in proper longitudinal relationship to tube 24 by means of lip-like protuberance or bead 12 on the outer wall portion of tube 22. Protuberance 32 rests against the top edge portion of tube 24 facilitating rotational movement of tube 22 relative to tube 24.

As here embodied and shown in both FIGS. 1A and 1B there is further provided a lever 34 attached to the exterior wall of tube 22 and projecting through alot 36 in a side wall portion of tube 24. By movement of lever 34 in a counterclockwise direction about the longitudinal axis of tube assembly 16, openings 28 and 30 can be registered one with the other providing atmospheric access to the interior of tube assembly 16. Provision for lever 34 is particularly important to effect rotational movement if the exterior end of tube 24 extends to or beyond the end of tube 22.

Figure 2:
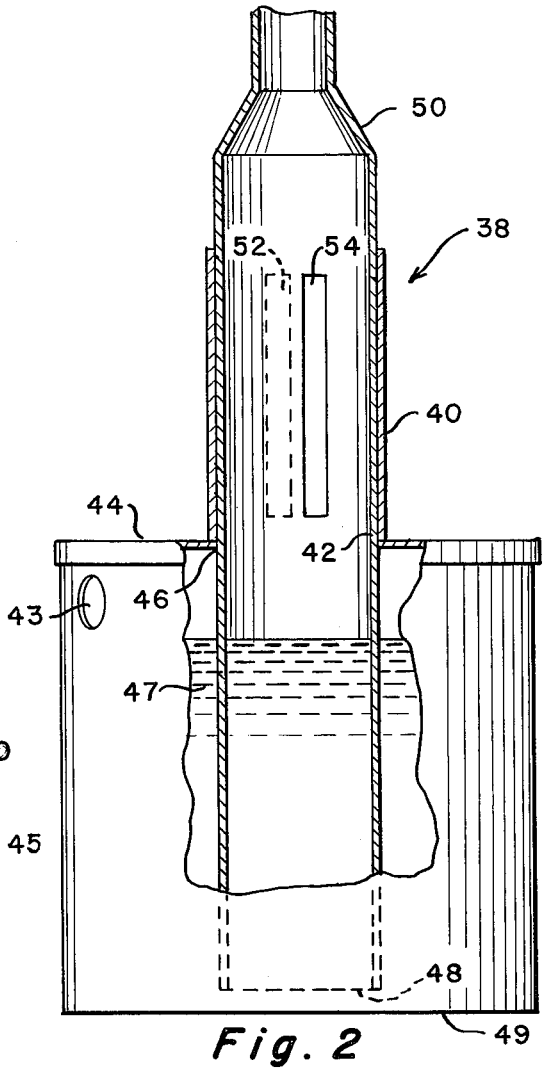

FIG. 2 is a partial cross section showing the tube assembly of a modification of the embodiment shown in FIG. 1. As here embodied the tube assembly 38 includes a first tube 40 which is slidably coupled to and concentric with a second tube 42. The assembly 38 is affixed to and projects through the lid portion 44 of the container 45 which contains liquid 47. As shown in FIG. 2 the stationary second tube 42 is affixed at its perimeter 46 to lid 44.

Preferably the tube assembly 38 has a first end 48 which is adjacent the bottom wall 49 of the container. As herein embodied end 48 is a part of stationary tube 42. The first tube 40 may also be located within container 45 although not here shown. In that case the first end 48 of tube assembly 38 may be either the first tube 40 or the stationary tube 42.

Tube assembly 38 also has a second end 50 which is exterior of the container 45 and is adapted to be inserted into the mouth of a user. As shown here the second end 50 is a part of stationary 42. However the first tube 40 can be extended longitudinally of the assembly 40 and its end adapted as a user end if desired.

Both first and second tubes 40 and 42 have provision for longitudinal rectangular openings 52 and 54 respectively. The openings 52 and 54 in the respective tubes can be selectively registered one with the other by rotational movement of the first tube 40 relative to the second stationary tube 42. When openings 52 and 54 are registered and the exterior atmosphere communicates with the interior of the tube assembly 38 through the openings 52 and 54, the user must increase his inspiratory effort to withdraw the same volume of liquid at a constant rate.

Figure 1C:
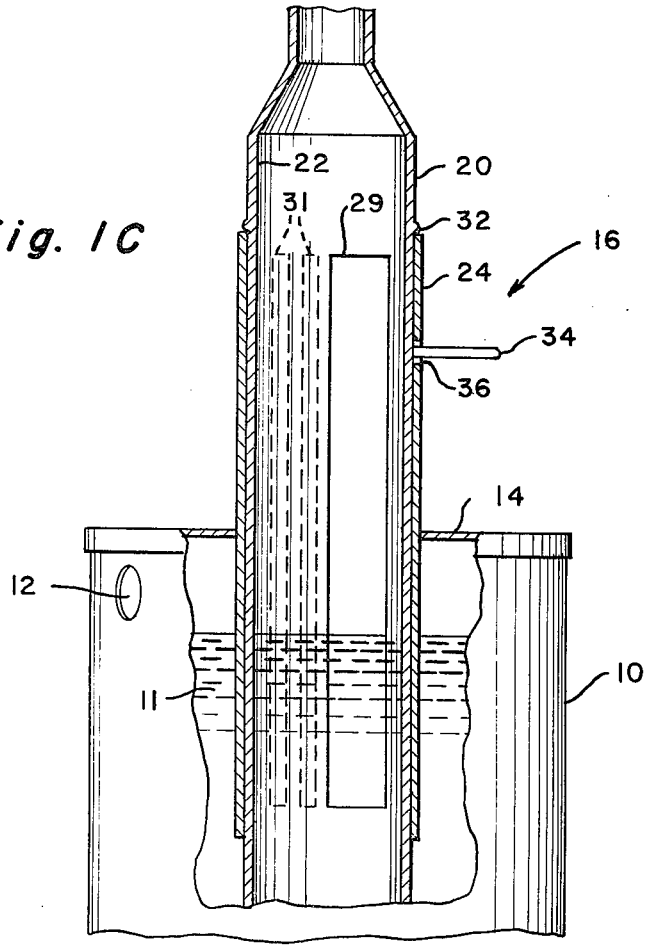

In the embodiment shown in FIGS. 1 and 2, only one opening in the wall of each tube is shown for simplicity of presentation, but additional openings can be provided if desired. A greater range of adjustment for inspiratory effort required versus liquid ingested can thereby be obtained. As shown in FIG. 1C, one wide opening 29 can be provided in the wall portion of one tube and a plurality of narrower openings can be provided in the second tube. Rotation of one tube relative to the other will continuously bring one or more of the narrower openings into simultaneous registration with the wider opening. This gives the user a wider range of adjustment of inspiratory effort required versus the volume of liquid ingested.

Figure 3A:
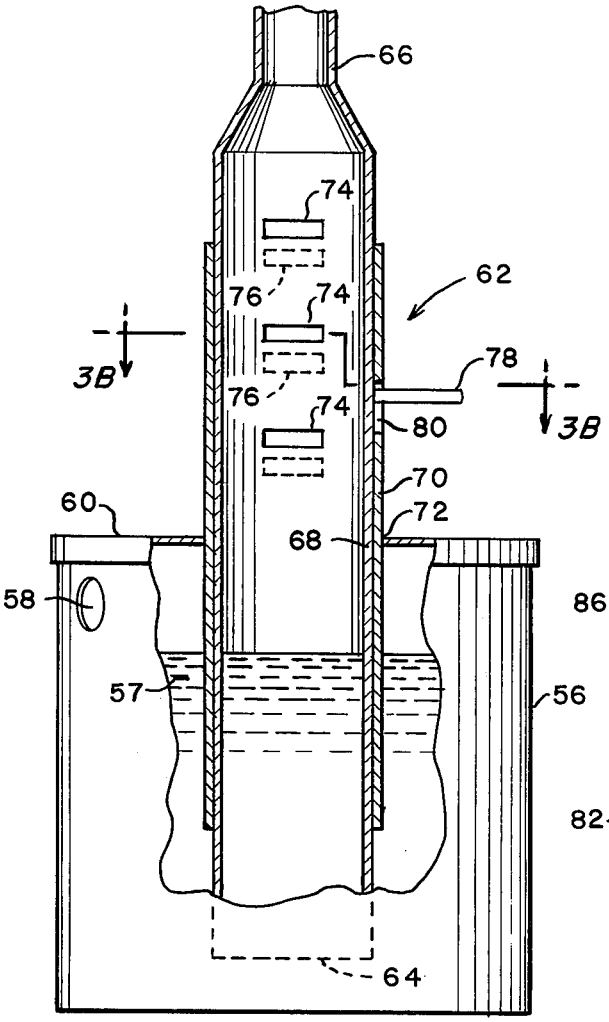
FIGS. 3A, 3B and 4 are preferred embodiments of the present invention shown schematically and in partial cross section wherein the opening apertures in the side walls of the tube assembly are adjusted by longitudinal movement of the tubes.
Figure 3B:
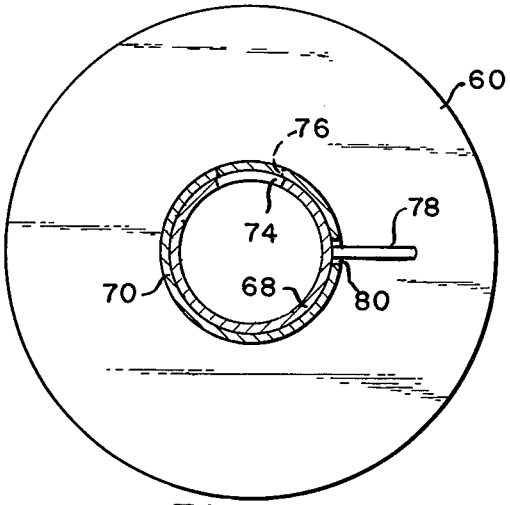

Referring now to FIGS. 3A and 3B there is shown schematically and in partial cross section another preferred embodiment of the present positive reinforcement respiratory inhalation device. As shown in FIG. 3A the adjustment of the movable tube is made in a longitudinal direction selectively increasing the opening apertures in the wall portions of the tubes to communicate with the exterior atmosphere or decreasing the apertures to reduce communications with the exterior atmosphere.

As embodied in FIG. 3A a container 56 for holding liquid is provided with at least one opening 58 in a wall portion thereof which communicates exterior atmospheric pressure to the surface of liquid 57. Preferably container 56 also includes a wall portion identified as lid portion 60. The lid portion 60 can be mounted to container 56 in a removable yet airtight manner such as by a simple friction fit or by mating threads. The lid 60 may alternatively be permanently affixed to the container 56.

As here embodied a tube assembly 62, having first and second ends 64 and 66 respectively, is affixed to and projects through the lid portion 60 of container 56. The tube assembly 62 includes a first tube 68 slideably coupled to and concentric with a second tube 70. As embodied in FIG. 3 tube 68 slides longitudinally of the tube assembly 62. First tube 68 slides longitudinally relative to the stationary tube 70. As here embodied the stationary tube 70 is affixed to lid portion 60 around its perimeter as shown at 72. The first end 64 of the tube assembly 62 projects to a point adjacent the bottom of container 56 and the assembly 62 provides open communicating access between first end 64 and second end 66 which is exterior of container 56 and adapted to be inserted into the mouth of a user.

Preferably at least one of the first and second tubes 68 and 70 is provided with openings in a side wall portion thereof. As shown in FIG. 3 openings 74 and 76 are provided in the walls of tubes 68 and 70 respectively which are registered one with the other by a slideable longitudinal movement of the first tube 68 relative to the second tube 70. By this movement the aperture of the openings, admitting access to the exterior atmosphere, can be increased or decreased. It will be recognized that if openings are provided only in one tube, the occluding wall portion of the other tube must be removed to result in open access to the interior of tube assembly 62. However, unlike the embodiments shown in FIGS. 1A, 1B and 2 the embodiment shown in FIGS. 3A and 3B will operate with openings in the wall portion of but one tube.

As here embodied the first movable tube 68 has a plurality of openings 74 located at selected heights on its wall. As here embodied the openings 74 are horizontally disposed and rectangular in shape. Similar openings 76 are provided in a wall portion of the stationary tube 70. By longitudinal movement of tube 68 relative to tube 70 the openings 74 can be registered with one or more of the openings 76 providing atmospheric access to the interior of tube assembly 62.

As shown in FIG. 3A the first end 64 of tube assembly 62 is adjacent the bottom of container 56 and comprises end portions of both tubes 68 and 70. Although either tube 68 or 70 can be positioned with its end near the bottom of container 56, in this particular embodiment it is most convenient to have the stationary tube 70 mounted in container 56 so that the end is always near the bottom of container 56 thus making the device functional substantially until container 56 is empty of liquid.

The second end 66 of tube assembly 62 is shown in FIG. 3A is comprised only of the end portion of first tube 68. However, the stationary tube 70 can be extended longitudinally beyond tube 68 and its end portion be adapted as the user end of tube assembly 62. In that configuration in particular and shown in FIGS. 3A and 3B, a lever 78 attached to the first tube 68 through slot 80 in wall portion of stationary tube 70 is used to longitudinally adjust the tube 66 relative to tube 70. Lever 78, when moved in a longitudinal direction relative to the tube assembly 62, can selectively register openings 74 with openings 76 or occlude them.

Figure 4:
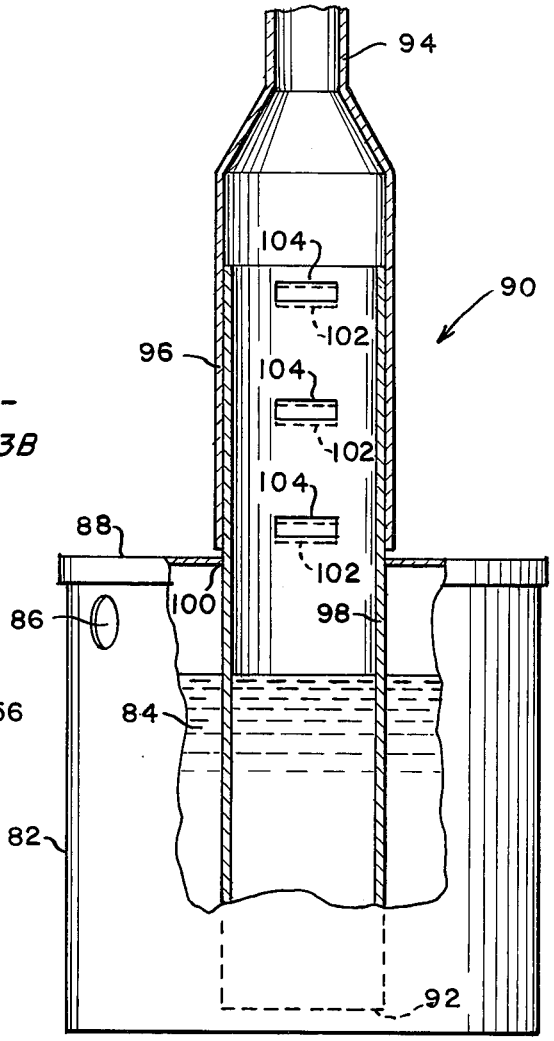

Referring now to FIG. 4 a variation of the embodiment in FIG. 3 is shown wherein the first tube is mounted around the outside periphery of the second stationary tube. In FIG. 4 an improved positive reinforcement respiratory inhalation device is shown which includes container 82 for holding a liquid 84 which has at least one opening 86 in a wall portion thereof communicating exterior atmospheric pressure to the surface of liquid 84. The container 82 further includes a lid portion 88 which is mounted as before described for the embodiment of FIGS. 3A and 3B.

A tube assembly 90 having first and second ends 92 and 94 is affixed to and projects through the lid portion 88 of container 82. The tube assembly 90 includes a second tube 98. As shown in FIG. 4, the second tube 98 is stationary and is affixed at its perimeter 100 to lid portion 88.

As herein embodied the first end 92 of tube assembly 90 is comprised only of the end portion of stationary tube 98. In this embodiment, end 92 remains always adjacent the bottom of container 82 regardless of adjustments in the first tube 96 relative to the second tube 98.

The second or user end 94 of tube assembly 90 as shown in this embodiment is comprised of an end portion of movable tube 96. The wall portion of second tube 98 can, however, be extended longitudinally beyond the end wall portion of tube 96 and be adapted for insertion into the mouth of the user. The movable tube 96 can as well be located within container 82 concentric about tube 98. In that case, first end 92 of the tube assembly 90 may be comprised of either or both lower ends of the respective tubes 96 and 98.

Preferably at least one of the first and second tubes 96 and 98 is provided with openings in a side wall portion thereof. As shown in FIG. 4, openings 102 and 104 are provided respectively in the wall portions of first tube 96 and second tube 98. The openings are horizontally disposed and rectangular in shape and as shown are partially registered one with the other. Longitudinal slideable movement of tube 96 brings openings 102 and 104 into complete registration or if desired to a position where all openings in one tube are blocked by wall portions of the other tube.

The openings in the wall portions of the tube assembly shown in FIGS. 3A, 3B and 4 can be varied in numbers and shape to provide for different requirements of the user. For instance, a single opening, with its longitudinal dimension relatively longer, can be provided in the wall portion of one tube and a plurality of openings, with their longitudinal dimension relatively shorter, can be provided in the wall portion of the other tube. As one tube is moved relative to the other, additional narrower openings come into registration with the single wider opening. The user can thereby continuously adjust the ratio of inspiratory effort required versus volume of liquid ingested.

Referring now to FIGS. 5–8, embodiments are shown in which the tube assembly is affixed to a side wall portion or bottom wall portion of the container thereby obviating the need for a lid to the container. These embodiments have certain advantages which are noted below.

Figure 5:
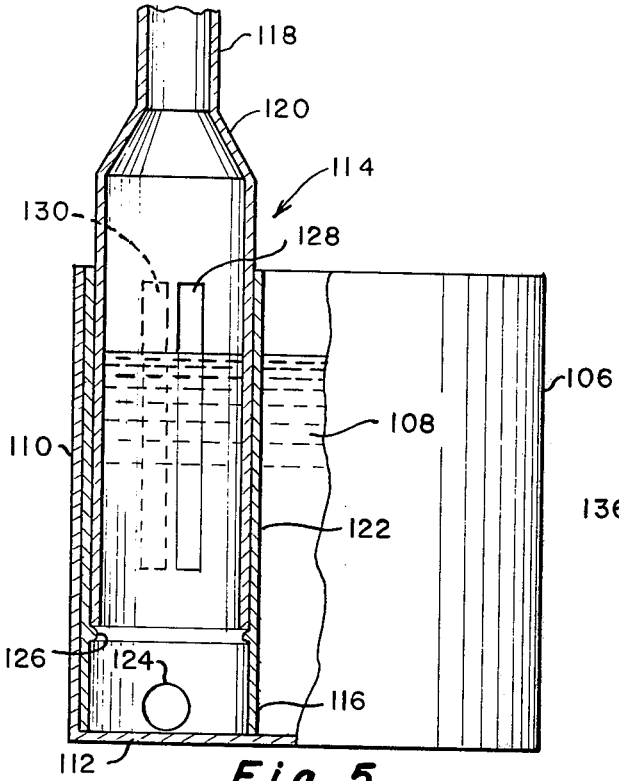

Referring to FIG. 5 an improved positive reinforcement respiratory inhalation device is shown which includes a container 106 for holding liquid 108. The container 106 has side wall portion 110 and bottom wall portion 112.

A tube assembly 114, having first and second ends 116 and 118, includes a first tube 120 which is slideably coupled to and concentric with a second tube 122. The tube assembly 114 is affixed to the side wall portion 110 of container 106 along the exterior surface of the stationary second tube 122. Since stationary tube 122 projects completely to the bottom wall portion 112 of container 106, an opening 124 is provided in the wall of tube 122 at the end 116 of assembly 114. The tube assembly 144 thereby is provided with opening communicating access between the first and second ends 116 and 118. The tube assembly 114 can as well project angularly through the side wall portion 110 and still function in an identical manner.

As herein embodied in FIG. 5 the first tube 120 fits within and concentric with the stationary second tube 122 resting upon interior wall lip-like protuberance or bead 126. As here embodied in FIG. 5 both tubes 120 and 122 are provided respectively with openings 128 and 130 which are rectangularly shaped and longitudinally disposed on the respective wall portions of the tubes. By a rotational movement of tube 120 about the longitudinal axis of assembly 114 and the openings 128 and 130 can be selectively registered one with another or occluded by wall portions of the other tube. As herein embodied the longitudinally disposed openings 128 and 130 are partially above the liquid level and partially below the liquid level. Thus as the user applies inspiratory effort to end 118 and withdraws liquid from container 106 the liquid level is reduced thereby increasing the aperture of the openings which communicate with the exterior atmosphere. When the openings 128 and 130 are registered one with the other, the user must constantly increase his inspiratory effort to remove liquid from the container as the liquid level is lowered.

Figure 6B:
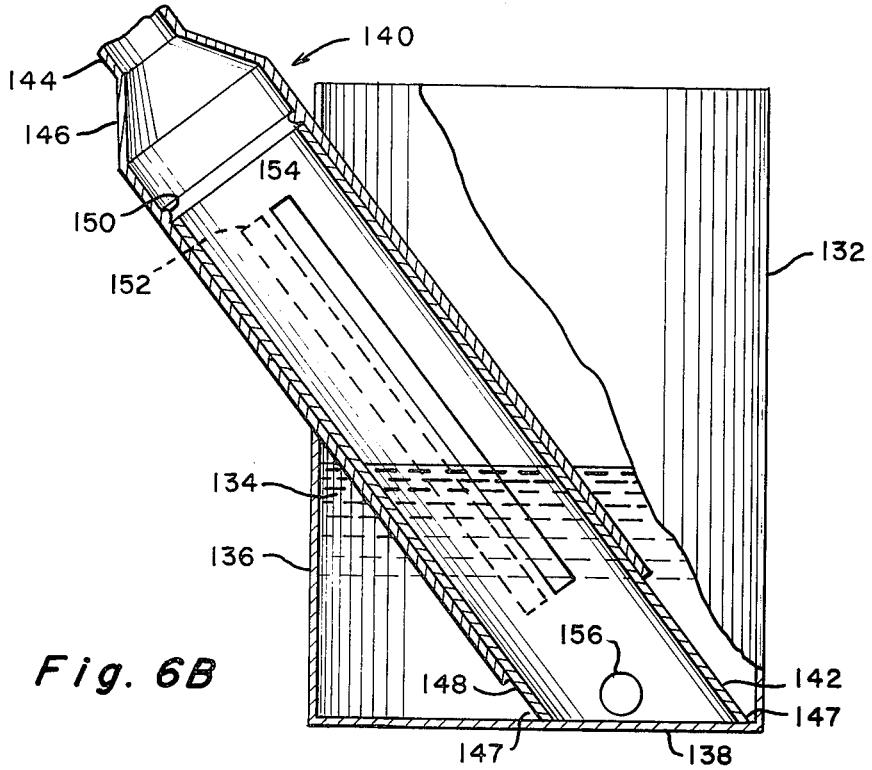
FIGS. 5, 6A, 6B, 7 and 8 are preferred embodiments of the present invention shown schematically and in partial cross section wherein the tube assembly is affixed to the bottom wall portion or side wall portion of the container.
Figure 6A:
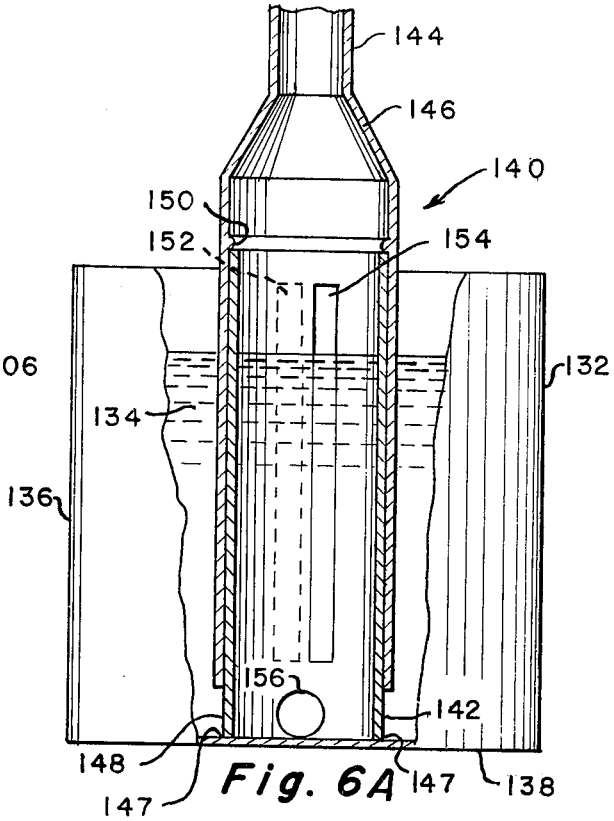

Referring now to FIG. 6A a variation of the embodiment shown in FIG. 5 is shown wherein the first movable tube is mounted exterior of the second stationary tube. More specifically as herein embodied, there is provided a container 132 for holding liquid 134. The container 132 has a side wall portion 136 and a bottom wall portion 138.

Preferably a tube assembly 140 having first and second ends 142 and 144 respectively is affixed to the bottom wall portion 138 of container 132. The tube assembly 140 includes a first tube 146 which is slidably coupled to and concentric with a second tube 148. As shown in FIG. 6 the second tube 148 is stationary and affixed to the bottom wall portion 138 at point 147. The stationary tube 148 is provided with an opening 156 in its side wall portion near the end 146 of assembly 140. Opening 156 provides for open communicating access between the first end 142 and the second end 144 of the tube assembly 140. Tube assembly 140 can as well be angularly disposed relative to container 132 and project through side wall portion 136 as is shown in FIG. 6B.

The slideably movable first tube 146 has interior wall protuberances or bead 150 which provide a lip which rests on the upper end of stationary tube 148. First tube 146 is thereby concentricly mounted on stationary tube 148 and is rotatable about the longitudinal axis relative to tube 148.

As with the embodiment shown in FIG. 5, the modified versions shown in FIGS. 6A and 6B are provided with longitudinally disposed openings 152 and 154 in the tubes 146 and 148 respectively. By rotational movement of first tube 146 the openings 152 and 154 are selectively registered one with the other or occluded by the tube wall. When the openings 152 and 154 are registered one with the other, the portion above the liquid level is in open communication with the exterior atmosphere.

Referring to FIGS. 5, 6A and 6B and the embodiments shown therein, for simplicity of presentation only one opening has been shown in wall portion of each of the tubes of the respective assemblies. However additional openings can be provided in either or both of the tubes of the assemblies. Thus the opening in the wall portion of one tube can be constructed with a relatively wider horizontal dimension and a plurality of openings can be provided in the wall of the other tube which have relatively narrower horizontal dimensions. As the first tube is then rotated the wider opening can sequentially register with one and then more of the narrower openings providing greater adjustment capability for the user.

The openings shown in the two embodiments of FIGS. 5, 6A and 6B are disposed longitudinally of the respective tube assemblies such that part of each opening is above the liquid level and part is below the liquid level. As the user withdraws liquid from the container, provided openings in the two tubes are registered, a constantly increasing inspiratory effort will be required to remove liquid from the container as the liquid level falls. It is clear however, that the tube assemblies in each of these assemblies in each of these embodiments can be constructed so that the openings are always above the liquid level and the inspiratory effort required by the user always will be constant to withdraw a given volume of liquid from the container regardless of the liquid level.

Figure 7:
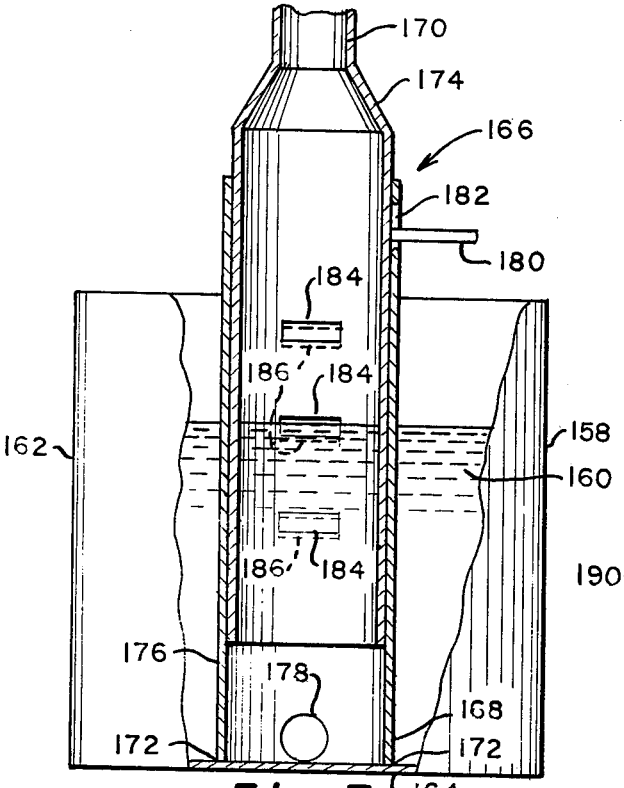

Referring now to the embodiment shown in FIG. 7 another modification of the positive reinforcement respiratory inhalation device of this invention is shown. A container 158 for holding liquid 160 has side wall portion 162 and bottom wall portion 164.

A tube assembly 166 having a first and second end 168 and 170 respectively is affixed to the bottom wall portion 164 at points 172. The tube assembly 166 includes a first tube 174 which is slideably coupled to and concentric with a second tube 176. The second tube 176 is stationary and is fixably mounted to the bottom wall portion 164. Adjacent end 168 of assembly 166 in the wall of tube 176 there is provided an opening 178. Open communicating access is thereby provided between the first and second ends 168 and 170 of the tube assembly 166.

The second end 170 of tube assembly 166 as shown in FIG. 7 is comprised of the end portion of tube 174 and is adapted for insertion into the mouth of a user. The stationary second tube 176 can be extended so that its end extends beyond the end of tube 174 and would then constitute the second end of tube assembly 166. In such case since the slideably movable tube 174 would be completely interior to the stationary tube 176, a lever 180 attached to a side wall portion of tube 174 and extending through a slot 182 in the wall portion of tube 176 would be required to adjust tube 174 upwards or downwards.

As embodied in FIG. 7 tubes 174 and 176 are provided with a plurality of openings 184 and 186 in their respective side walls. As shown some of the openings 184 and 186 are provided in wall portions of the respective tubes above the liquid level and others are provided in wall portions of the respective tubes below the liquid level. The tube assembly 166 can be constructed so that all openings are always above the liquid level by extending assembly 166 vertically and locating the openings above the top edges of the container 158.

The openings 184 and 186 are selectively registered one with another or occluded by wall portions of the other tube by movement of the tube 174 longitudinally of the assembly 166. As here shown, openings 184 and 186 are partially registered. As shown in FIG. 7, since the openings 184 and 186 continue below the liquid level, a constantly increasing inspiratory effort is required by the user to remove liquid from the container as the liquid level lowers.

Figure 8:
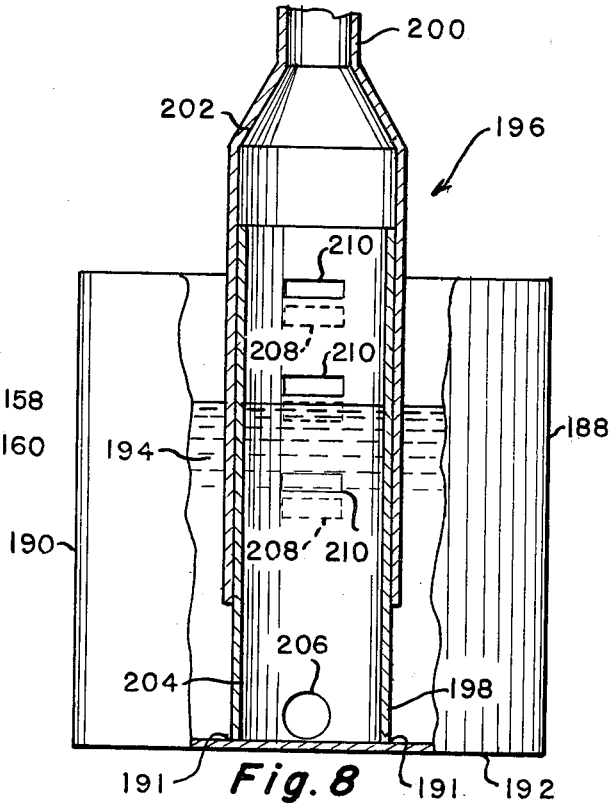

Referring now to FIG. 8 there is shown an embodiment of the present invention which is a modification to the embodiment shown in FIG. 7. More specifically the slideably movable tube of the tube assembly is mounted on the outside of the stationary tube.

In FIG. 8 there is shown a container 188 having side wall portion 190 and bottom wall portion 192. Container 188 is adapted to hold liquid 194. Preferably a tube assembly 196 having first and second ends 198 and 200 respectively is affixed to the bottom wall portion 192 of container 188 at points 191. The assembly 196 includes a first tube 102 which is slideably coupled to and concentric with a second tube 204. The second tube 204 being affixed to the bottom wall 192 of container 188 is provided with an opening 206 which allows open communicating access between the first and second ends 198 and 200 of the tube assembly 196.

Preferably openings are provided in the side walls of both tubes 202 and 204. As here embodied the openings 208 and 210 are of rectangular shape located parallel to the longitudinal axis of tube assembly 196. Be slideable movement of first tube 202 relative to second tube 204 the openings 208 and 210 can be selectively brought into registration or occluded by wall portions of the other respective tube. As shown in FIG. 8 some openings 208 and 210 are below the liquid level while others are above the liquid level. Consequently, as the user removes liquid from the container and the liquid level drops there will be required a constantly increasing inspiratory effort to remove liquid from the container. As in the embodiment shown in FIG. 7, the openings 208 and 210 can be so located as to always be above the level of liquid thereby requiring the same inspiratory effort to remove a particular volume of liquid regardless of the level of liquid in the container 188. Further, since the movable tube 208 is mounted on the exterior of the stationary tube 204 no levers are required to facilitate movement of the tube 202. It will be recognized that the second tube 204 can extend beyond the end of tube 202 and the exterior end of tube 204 be adapted for insertion into the mouth of a user.

Referring to FIGS. 7 and 8, each can be constructed with openings in the wall of only one or the other of the tubes of the respective tube assemblies. In such case the openings in the wall of one tube are occluded by the wall of the the other tube and by relative movement of the tubes the openings are moved beyond the wall of the occluding tube to increase the communication with the exterior atmosphere. As was described with regard to the embodiment of FIGS. 5, 6A and 6B, the respective tube assemblies of these latter embodiments can be angularly disposed relative to the container and can project through the side wall thereof.

What is claimed is:

1. A positive reinforcement respiratory inhalation device, including provision for controlled ingestion of liquid into the mouth of a user, comprising in combination:

a container having a side wall portion and a bottom wall portion for holding said liquid, said container having an upper part thereof open to ambient pressure;

a tube assembly including a lower tube having one end affixed at the bottom wall portion of said container and the other end extending to the approximate height of said container and an upper tube having one end slideably coupled to and concentric with said lower tube other end and the other end of said upper tube extending exteriorly of said container, said upper and lower tubes, in concentric relationship including an unobstructed passage therethrough;

said tube assembly being provided with an opening in a wall portion thereof adjacent said one end of said lower tube; and at least one of said upper and lower tubes being provided with at least one opening in a side wall portion thereof at least adjacent the height of said side wall whose aperture is adjustable by slideably moving said upper tube relative to said lower tube.

2. The positive reinforcement respiratory inhalation device of claim 1 wherein said upper tube is adjustable relative to said lower tube by a rotational movement about the longitudinal axis of said tube assembly.

3. The positive reinforcement respiratory inhalation device of claim 1 wherein said upper tube is adjustable relative to said lower tube by a longitudinal slideable movement in the direction of the longitudinal axis of said tube assembly.

4. The positive reinforcement respiratory inhalation device of claim 1 wherein said lower and upper tubes are both provided with at least one opening in a sidewall portion thereof which are registerable one with the other by a rotating movement of said upper tube relative to said lower tube.

5. The positive reinforcement respiratory inhalation device of claim 1 wherein said upper and lower tubes are both provided with at least one opening in side wall portions thereof and said openings are registerable one with the other by longitudinal slideable movement of said upper tube relative to said lower tube.

6. The positive reinforcement respiratory inhalation device of claim 1 wherein said tube assembly is further attached to the side wall portion of said container.

7. A positive reinforcement respiratory inhalation device, including provision for controlled ingestion of liquid into a mouth of a user, comprising in combination:

a container for holding said liquid having a side wall portion, a lower wall portion and a lid portion, an opening in at least one of said side wall portion adjacent the upper end of said side wall portion or said lid portion which communicates exterior atmospheric pressure to the interior of said container;

a tube assembly having a first tube having first and second ends and a second tube having first and second ends, said first tube slideably coupled within and concentric to said second tube, said second tube affixed to and projecting through said lid portion with said first end extending interiorly of said container and said second end extending exteriorly of said container, said first tube having said first end extending from said first end of said second tube a distance adjacent the bottom of said container and said second end extending from said second end of said second tube exteriorly of said container, said first and second tubes, when in concentric relationship, including an unobstructed passage therethrough providing open communicating access between said first ends of said first and second tubes and said second ends of said first and second tube exterior of said container and said second end of said first tube adapted to be inserted into the mouth of a user;

said first and second tubes having at least one opening in each of said respective wall portions thereof at least adjacent the lid portion, said respective openings extending longitudinally of said tube assembly and being registerable one with the other by slideable movement of the first tube relative to the second tube;

whereby slideably moving the first tube relative to the second tube in a given direction the openings in the wall portions of the respective tubes can be brought into registration one with another so that when said container holds liquid and a given inspiratory effort is applied to said second end of said tube assembly a lesser volume of liquid is withdrawn then when said respective openings are not in registration.

8. The positive reinforcement respiratory inhalation device of claim 7 wherein the respective openings in the wall portions of the first and second tubes are of different size.

9. The positive reinforcement respiratory inhalation device of claim 7 wherein both said first and second tubes are provided with openings in the side walls thereof and the first tube is rotated relative to the second tube to selectively register the openings one with the other.

10. The positive reinforcement respiratory inhalation device of claim 7 wherein the first tube is moved longitudinally of the second tube to selectively vary the apertures of the openings.

11. A positive reinforcement respiratory inhalation device, including provision for controlled ingestion of liquid into the mouth of a user, comprising in combination:

a container for holding said liquid having a side wall portion, a lower wall portion and a lid portion, an opening in at least one of said side wall portion adjacent the upper end of said side wall portion or said lid portion which communicates exterior atmospheric pressure to the interior of said container;

a tube assembly including a first tube having first and second ends and mounted exteriorly of said container and second tube having first and second ends, said second end of said first tube slideably coupled outside of and concentric to said second end of said second tube, said second tube affixed to and projecting through said lid portion having said first end extending a distance adjacent the bottom of said container and having said second end extending exteriorly of said container; said first and second tubes, when in concentric relationship, including an unobstructed passage therethrough providing open communicating access between said first end of said second tube and said first end of said first tube exterior of said container and said first end of said first tube adapted to be inserted into the mouth of the user;

said first and second tubes having at least one opening in each of said respective wall portions thereof, at least adjacent the lid portion, said respective openings extending longitudinally of said tube assembly and being registerable one with the other by slideable movement of the first tube relative to the second tube;

whereby by slideably moving the first tube relative to the second tube in a given direction the openings in the wall portions of the respective tubes can be brought into registration one with another so that when said container holds liquid and a given inspiratory effort is applied to said second end of said tube assembly a lesser volume of liquid is withdrawn than when said respective openings are not in registration.

12. A positive reinforcement respiratory inhalation device, including provision for controlled ingestion of liquid into the mouth of user, comprising in combination:

a container for holding said liquid having a side wall portion, a lower wall portion and a lid portion, an opening in at least one of said side wall portion adjacent the upper end of said wall portion or said lid portion which communicates exterior atmospheric pressure to the interior of said container;

a tube assembly including a first tube having first and second ends and a second tube having first and second ends, said first tube slideably coupled inside of and concentric to said second tube, said second tube affixed to and projecting through said lid portion having said first and extending interiorly of said container and having said second end extending exteriorly of said container; said first tube having said first end extending from said first end of said second tube a distance adjacent the bottom of said container and having said second end extending exteriorly from said second end of said second tube, said first and second tubes, when in concentric relationship, including an unobstructed passage therethrough providing open communicating access between said first ends of said first and second tubes and said second ends of said first and second tubes exterior of said container and said second end of said second tube adapted to be inserted into the mouth of the user;

said first and second tubes having at least one opening in each of said respective wall portions thereof, at least adjacent the lid portion, said respective openings extending longitudinally of said tube assembly and being registerable one with the other by slideable movement of the first tube relative to the second tube;

whereby by slideably moving the first tube relative to the second tube in a given direction the openings in the wall portions of the respective tubes can be brought into registration one with another so that when said container holds liquid and a given inspiratory effort is applied to said second end of said tube assembly a lesser volume of liquid is withdrawn then when said respective openings are not in registration.

13. A positive reinforcement respiratory inhalation device, including provision for controlled ingestion of liquid into the mouth of a user, comprising in combination:

a container for holding said liquid having a side wall portion, a lower wall portion and a lid portion, an opening in at least one of said side wall portion adjacent the upper end of said side wall portion of said lid portion which communicates exterior atmospheric pressure to the interior of said container;

a tube assembly including a first tube mounted exteriorly of said container and having a first end adapted to be inserted into the mouth and a second end and a second tube having first and second ends, said second tube affixed to and projecting through said lid portion having said first end extending a distance adjacent the bottom of said container and having said second end extending exteriorly of said container; said second end of said first tube being slideably coupled outside of and concentric to said second end of said second tube. said first and second tubes, when in concentric relationship, including an unobstructed passage therethrough providing open communicating access between said first end of said second tube and said first end of said first tube exterior of said container;

said first and second tubes having at least one opening in each of said respective wall portions thereof, at least adjacent the lid portion, said respective openings extending longitudinally of said tube assembly and being registerable one with the other by slideable movement of the first tube relative to the second tube;

whereby by slideably moving the first tube relative to the second tube in a given direction the openings in the wall portions of the respective tubes can be brought into registration one with another so that when said container holds liquid and a given inspiratory effort is applied to said second end of said tube assembly a lesser volume of liquid is withdrawn than when said respective openings are not in registration.

14. A positive reinforcement respiratory inhalation device, including provision for controlled ingestion of liquid into the mouth of a user, comprising in combination:

a container having a side wall portion and a bottom wall portion for holding said liquid, said container having an upper part thereof open to ambient pressure;

a tube assembly including a first tube having one end affixed at the bottom wall portion of said container and the other end extending exterior of said container and a second tube having one end slideably coupled to and concentric with said lower tube and the other end adapted to be inserted into the mouth of a user, said first and second tubes in concentric relationship including an unobstructed passage therethrough;

said tube assembly being provided with an opening in a wall portion thereof adjacent said one end of said lower tube; and at least one of said upper and lower tubes being provided with at least one opening in a side wall portion thereof at least adjacent the height of said side wall whose aperture is adjustable by slideably moving said upper tube relative to said lower tube.

* * * * *